United States Patent [19]

Mårtensson

[11] Patent Number: 4,657,175

[45] Date of Patent: Apr. 14, 1987

[54] PACKAGE

[75] Inventor: Kjell H. Mårtensson, Malmö, Sweden

[73] Assignee: Tetra Pak International AB, Lund, Sweden

[21] Appl. No.: 710,516

[22] Filed: Mar. 11, 1985

Related U.S. Application Data

[63] Continuation of Ser. No. 472,880, Mar. 8, 1983, abandoned.

[30] Foreign Application Priority Data

Mar. 18, 1982 [SE] Sweden ..... 8201719

[51] Int. Cl.[4] ..... B65D 17/00

[52] U.S. Cl. ..... 229/17 R; 229/DIG. 4

[58] Field of Search ..... 229/17 R, 17 G, DIG. 4; 206/616, 617

[56] References Cited

U.S. PATENT DOCUMENTS

| | | | |
|---|---|---|---|
| 3,232,514 | 2/1966 | Swede et al. | 229/17 R |
| 3,347,444 | 10/1967 | Rausing et al. | 229/17 R |
| 3,795,359 | 3/1974 | Rausing | 229/17 R |
| 3,797,726 | 3/1974 | Reil | 229/17 R |
| 4,078,715 | 3/1978 | Larsson et al. | 229/DIG. 4 |
| 4,248,351 | 2/1981 | Berg | 229/17 R |
| 4,267,957 | 5/1981 | Holmström | 229/17 G |
| 4,327,833 | 5/1982 | Kuchenbecker | 229/17 R |
| 4,362,245 | 12/1982 | Kuchenbecker | 229/17 R |
| 4,433,784 | 2/1984 | Kjelgaard | 206/617 |

FOREIGN PATENT DOCUMENTS

| | | | |
|---|---|---|---|
| 1441426 | 6/1976 | United Kingdom | 229/17 R |

*Primary Examiner*—Stephen P. Garbe

*Attorney, Agent, or Firm*—Burns, Doane, Swecker & Mathis

[57] ABSTRACT

The invention relates to a package of the type having a container body with four side walls, opposite each other in pairs, and a top end wall which along a lateral edge is joined to the container body through a triangular, double-walled lug. The package, moreover, possesses a sealing fin which extends from the point of the said triangular lug and out over the top end wall. This sealing fin is folded down along at least a portion of its length against the top end wall and is retained in its folded down position. The said sealing fin has one or more cuts or perforations weakening the packing material. The cuts are arranged preferably at right angles to the sealing fin in the material layer of the sealing fin which is nearest to the top end wall in the folded down position of the sealing fin.

6 Claims, 4 Drawing Figures

PACKAGE

This application is a continuation of application Ser. No. 472,880, filed Mar. 8, 1983, now abandoned.

BACKGROUND AND SUMMARY OF THE INVENTION

The present invention relates to a package of the type having a container body consisting of four side walls, opposite each other in pairs, and a bottom and a top end wall. More specifically, the present invention relates to a package in which the top end wall is joined along each of two opposite lateral edges to two triangular, double-walled lugs, and a sealing fin projecting from the end wall, wherein two material layers are joined to one another inside-to-inside, extends over the top end wall as well as over the top sides of the triangular lugs up to their points.

It is known in the technology of packaging that packages can be manufactured by starting out from a web-like packing material which is folded up to a tube. The longitudinal edges of the web are joined together in a sealing joint, and the tube formed is filled with the intended contents, e.g. milk, fruit juice or othr fluid or semifluid products. Thereafter the tube filled with contents is sealed off by repeated transverse seals along narrow flattening zones situated at a distance from one another at right anlges to the tube axis so as to form sealed tube sections filled with contents. The tubes are then form-processed by folding to parallelepipedic packages which are separated from the tube by means of cuts in the sealing zones. Packages of the type mentioned here have double-walled, triangular lugs along four of the corner edges of the packages and a standup sealing fin alongside the top and bottom end surfaces of the packages. Moreover, these sealing fins extend over the triangular lugs up to their points.

The packages of the type specified here are used very generally for packaging in the distribution of, for example, milk and fruit juices. The packages are usually opened with one of the triangular lugs, which are folded down and sealed to the side wall of the package, being raised up and cut off so that an emptying channel is formed which communicates with the inside of the package.

It has proved advantageous in certain cases to place an opening cut in the sealing fin for opening the sealing fin within the desired opening region, which includes the part of the fin extending over one of the triangular lugs and over a part of the adjoining top end wall of the package. The sealing fin is opened by breaking up the sealing bond between the sealed layers in the sealing fin, through the insertion of a tear-wire or a tear-strip in the sealing fin. Another method of providing an opening in the sealing fin includes arranging the actual seal of the sealing fin at its free outer edge and providing below the seal but above the base line of the fin a cut or tear perforation alongside the fin.

In forming an emptying channel through which the contents of the package can be poured out in a convenient manner, it is not enough, however, just to create an opening in the fin either by tearing up the sealing bond of the fin or by cutting or ripping open a longitudinal cut through the fin. The slotlike opening has to be widened to form a pouring channel with a greater passage area. It is known that such a larger emptying channel can be formed by raising up and pushing back the opened lug so as to produce a rhomboid opening. However, it has also been found that the formation of such an opening is rendered considerably more difficult if the sealing fin or parts of the sealing fin form the opening edge of the emptying channel. The reason for this is that the sealing fin normally is inclined or folded down towards the top end wall of the package and to a certain extent is even locked in this inclined or folded down position owing to the triangular lug, which is positioned opposite the lug used as an emptying opening, being folded in against the side wall of the package. This means that the sealing fin is forced to rest against the top end wall of the package at least along parts of the end wall. This tendency of the sealing fin to slope against the top side wall of the package has the result that the formation of the rhomboid emptying opening is made difficult. Instead of a rhomboid opening, frequently an angular, practically slotlike opening is obtained, since the one side of the triangular lug fails to "fold out" in the intended manner, but instead is folded-in in the opposite direction. This is generally referred to as a "collapsed lug".

The reason for these collapsed lugs is that the sealing fin or parts of the sealing fin form a relatively rigid "frame". The parts of the sealing fin which slope towards the top end wall do not have any natural tendency to fold outwards but instead, because of the stresses which arise in the "frame", more readily fold inwards to produce the above-mentioned result.

The package according to the pesent invention eliminates the disadvantages associated with the prior art. According to the present invention, a package is provided having a container body formed from a packing material. The package includes four side walls located opposite each other in pairs, a bottom end wall and a top end wall which is joined along each of two opposite lateral edges to two, triangular, double-walled lugs. A sealing fin extends over the top end wall and top sides of the triangular lugs to a point of each lug. The sealing fin, which is formed by joining inside layers of the packing material, is folded down along at least a portion of its length against the top end wall and is retained in its folded down position. A region of the sealing fin is adapted to be torn open in order to form an emptying channel in the package. At least one cut is provided in the sealing fin for weakening the packing material in order to inhibit collapse of the lugs when the package is opened.

BRIEF DESCRIPTION OF THE DRAWINGS

The invention will be described with reference to the enclosed schematic drawing wherein like elements bear like reference numerals

DETAILED DESCRIPTION OF THE PREFERRED EMBODIMENT

Figure 4:
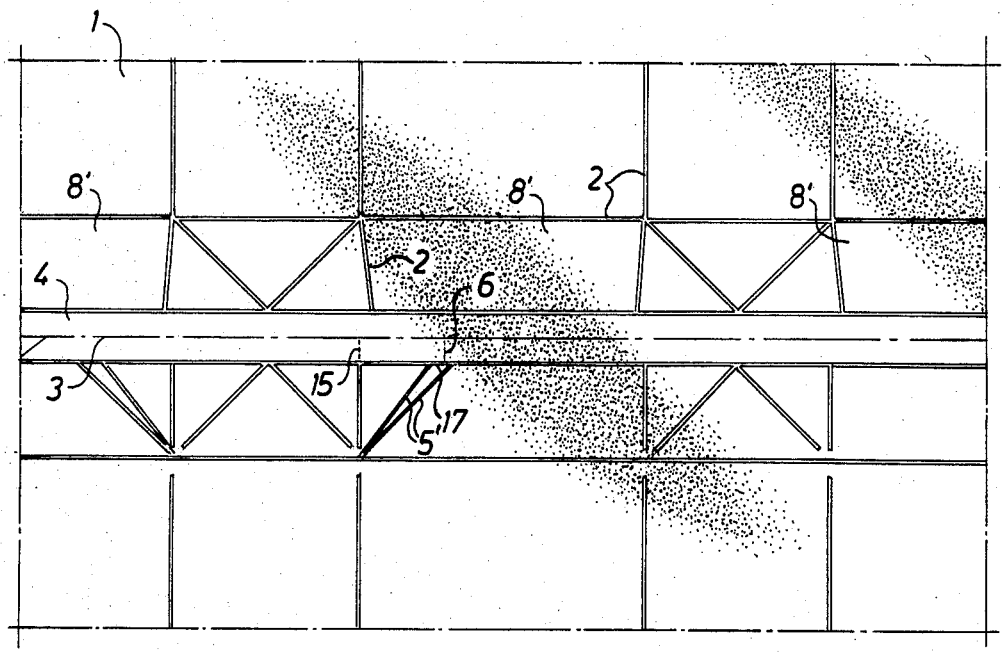
FIG. 4 is a section of a packing material web for the manufacture of a package in accordance with the invention.

Packages of the type which were mentioned above are manufactured from a plane packing material web 1 consisting of a base layer of paper or similar rigid material, this base layer being coated on either side with heat-sealable plastics, mostly polyethylene. In order to provide a gas-tight layer the laminate includes a layer of a barrier material, e.g. aluminum foil or a gas-tight plastic which preferably is fitted between the base layer and the heat-sealable thermoplastic layer which is intended to form the inside of the package. To facilitate the forming of the package, the material web 1, as can be seen in FIG. 4, is provided with a crease-line pattern 2 facilitating the fold formation. After the packing material web 1 has been folded to a tube and has been formed to packing units, the packing units are sealed in a liquid-tight manner along a flattened sealing zone, which is represented in FIG. 4 by the panel 4. This means that the individual packages are separated from each other also along this panel and the cutting line produced after the forming and sealing of the packages is marked by the dash-dotted line 3. In order to facilitate the formation of a pouring spout of the type which will be described in the following, the packing material web is provided for each complete crease-line pattern with a number of oblique crease-lines 5, which facilitate the opening up of the pouring spout. In addition the packing material web is provided at, or close to, the place where the crease-lines 5 join the flattening panel 4 with cuts 6 which penetrate through the base layer of the packing material and possibly its outer layer, but which leave intact the inner plastic layer, or with a perforation 6 which similarly leaves the inner plastic layer unbroken. The purpose of the said perforation will be described in more detail in the following.

Figure 1:
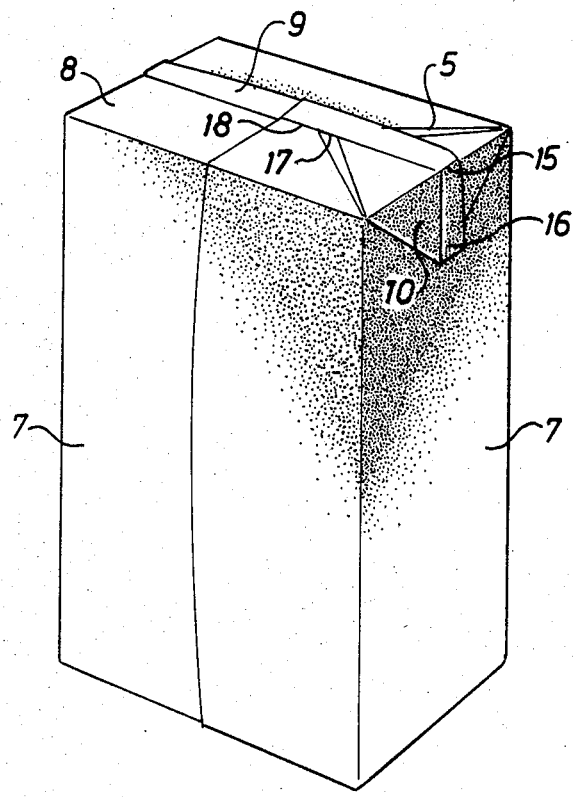
Fig. 1 PRIOR ART
FIG. 1 is a perspective view of an unopened packing container.

The packing material web 1 shown in FIG. 4, which consists of a repeated pattern of crease lines 2 facilitating the folding, is converted in the manner which has been described earlier to packing units. A part of the packing material web 1, which corresponds to a complete crease-line pattern, will produce one packing unit. In FIG. 1 is shown such a packing unit with sidewalls 7 opposite each other in pairs and a top end wall 8. The top end wall 8 is formed by the panel 8' of the packing material web shown in FIG. 4 and the sealing fin 9 is formed by the part of the panel 4 which is on one side of the dash-dotted line 3. On forming the packing containers double-walled, triangular lugs 10 are produced at the corners of the packages and the sealing fins 9 extend over the top end wall 8 of the package as well as over the said triangular, double-walled lugs 10 and terminate at the point 16 of the lugs 10.

The packing container of the type which is shown in FIG. 1 may be opened advantageously by tearing up a part of the sealing fin 9 below the seal from the point 16 of one of the double-walled lugs 10 up to the area 17 where the crease-lines 5 intersect the base line 18 of the sealing fin 9. However, especially in the case of completely filled packages, such an opening involves a certain risk of the contents being spilled during the opening operation. An improved opening can be obtained if the sealing fin is not torn off but instead the layers sealed to one another in the sealing fin are separated from one another in that the sealing bond between the layers is broken. When such a separation of the layers in the sealing fin 9 is taking place an opening is obtained, the edges of which are higher than when the sealing fin is torn off, with the result that the risk of spillage is reduced.

Figure 3:
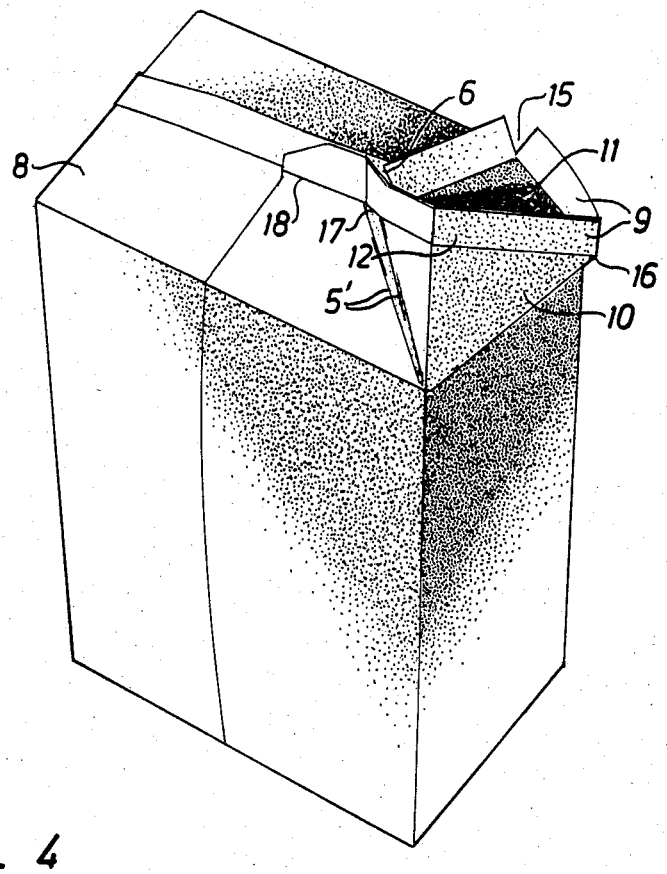
FIG. 3 is a perspective of an opened package in accordance with the invention.

The ripping open of the sealing bond between the layers in the sealing fin 9 may be done in a known manner with the help of a tear-wire or tear-strip inserted in the sealing zone, and the sealing bond between layers in the sealing fin is torn up preferably from the point 16 of the triangular lug to the area 17 where the crease-lines 5 intersect base line 18. By raising the lug 10 a rhomboid opening 11 can be formed in the manner as shown in FIG. 3, the opening 11 being defined by the parts of the sealing fin 9 which are separated from one another. These parts of the sealing fin 9 form a relatively stiff frame 12 which includes the panel 4 shown in FIG. 4. Since the sealing fin 9 in the area behind the parts which are separated is flattened against the top end wall 8 of the package, strong stresses arise in the transition between the flattened sealing fin 9 and the "frame" 12 of the opened sealing fin which forms the opening 11, and these stresses act against the formation of a rhomboid opening 11.

Figure 2:
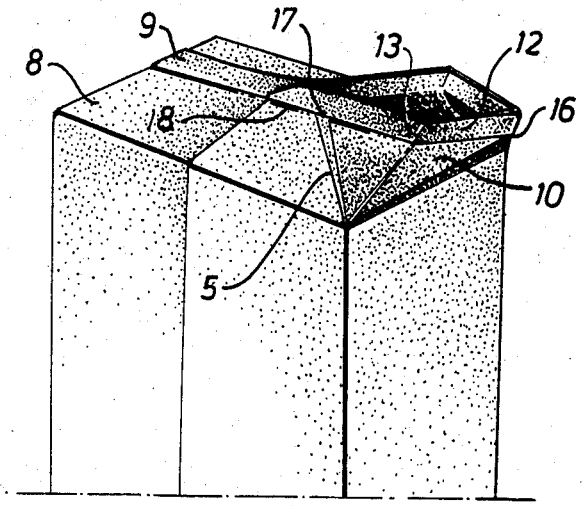
Fig. 2 PRIOR ART
FIG. 2 is a perspective view of an opened packing container with a so-called collapsed lug owing to the sealing fin hindering the formation of the opening.

As a result a so-called collapsed lug often occurs, as illustrated in FIG. 2. That is the break point 13 in the frame 12 is not folded outwards, in order to form a rhomboid opening 11, but instead inwards, thus greatly reducing the area of opening. As mentioned previously, this phenomenon occurs because of excessive stresses in the sealing fin 9 in the transition between the portion of the sealing fin 9 flattened against the top end wall 8 and the portion of the sealing fin which forms the opening 11. It has been found that the side of the opening 11 whose parts are joined to the parts of the sealing fin 9 which rest against the top end wall 8 are drawn inwards and cause the so-called collapsed lug. It has been found that the collapsed lug can be largely prevented if the packing material web 1 is provided in the flattened panel 4 with an incision or a perforation 6 which weakens the layer in the part of the fin which faces towards the top end wall 8 of the package. Naturally the weakening line 6 will have to be placed in the region of the blank which in the finished package forms the rear corner of the opening 11, that is to say the region 17 where the crease-lines 5 converge. If the packing material is provided with a weakening line or perforation line 6, which is placed in the appropriate region, the part of the "frame" 12, which is formed by the separated fin-forming layers, will be broken up when the package is opened, whereby the said frame 12 no longer will be connected directly to the flattened sealing fin 9. The stresses in the frame 12 will not be so great that a collapse of the lug is liable to occur.

To reduce further the risk of a collapse of the lug it has been found appropriate, in addition to the perforation or cut 6, to provide one layer of the sealing fin with the same kind of cut 15 in the region of the sealing fin 9 which is located on the boundary line between the top end wall 8 of the package and the triangular lug 10. As mentioned above, great stresses appear in the layer of the sealing fin 9 which, in flattened position, faces towards the top end wall 8 when the sealing fin 9 has been torn up to produce an opening arrangement, and a pouring spout 11 is formed by raising up the triangular lug 10. These stresses concentrate substantially upon the "frame" 12 which surrounds the opening hole 11 and which is formed by the material layer in the sealing fin 9. In the region where the perforation or the weakening line 6 is arranged, compressive stresses will appear, whereas tensile stresses will arise in the region where the perforation or weakening line 15 is provided. By providing the said perforation or weakening lines 6 and 15, the said stresses can be prevented due to the "frame" 12 being divided. Portions of the material layers of the fin 9 which form the said "frame" 12 will divide at the weakening point 6 in such a manner that after breaking up of the weakened position the material layers can place themselves on top of one another, thus eliminating the compressive stresses. Furthermore, the tensile stresses in the region of the weakening or perforation 15 cause the packing material to divide in the weakening line, so that a "crack" 15 appears in the frame 12.

One difficulty in the location of the weakening line or perforation 6 has been to decide exactly on the position for this weakening line, since the placing of the weakening line to a certain extent depends on how great a part of the fin 9 is torn up on opening of the package. It has been found that instead of one weakening line 6 a number of weakening lines or perforations 6, parallel to one another, may be provided in one layer of the fin 9. By providing a number of weakening or perforation lines 6 within the region of the sealing fin 9, where it is expected that the tearing up of the sealing fin is to start, a better degree of safety is achieved. A weakening or perforated line 6 will then be located right in the boundary region between the ripped open and the still sealed fin 9, since on opening of the package great stresses upon the fin 9 appear just in this region. It has also proved advantageous to arrange, in certain cases, the perforation lines 6 at a slope or angle, in relation to the sealing fin 9, and in particular sloping backwards in direction towards the sealed portion of the sealin fin 9.

A further measure which may be adopted to prevent the collapse of the lug includes, as shown in FIG. 3, doubling or multiplying the auxiliary crease-lines 5 provided in FIG. 1. These doubled crease-lines are designated 5' in FIG. 3 and, as shown, they originate from the corner points of the side of the top end wall 8 where the triangular lug 10 forming the pouring spout is located. The two crease-lines 5' diverge a little as they extend over the top end wall 8 to terminate close to the base line 18 of the sealing fin 9 on either side of the sealing fin 9. The end points of the crease-lines 5' at the base line 18 of the sealing fin 9 encompass an area of the sealing fin 9 within which the tearing up of the sealing fin 9 will start when the package is opened. As mentioned earlier, it is difficult to define exactly where the separation of the sealing fin 9 intended to form an emptying opening will start when a tear-cord or a tear-strip is used, since different handling of the tear-cord or tear-strip may bring about variations in the length of the portion ripped open. It is possible, of course, that certain tolerances may exist on insertion of the tear-strip or tear-cord. (Concerning opening arrangements with tear-strip or tear-cord, reference is made to SE PS No. 7214806-7).

It has been found that by a simple incision into the packing material a substantially safer formation of the opening of packages can be achieved which practically eliminates the risk of a collapse of the lug.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Accordingly, variations and changes may be made by those skilled in the art without departing from the present invention, as set forth in the appended claims.

What is claimed is:

1. In a package of the type having a container body formed from a multi-layer packing material with four side walls located opposite each other in pairs; a bottom end wall and a top end wall, the top end wall including two triangular, double-walled lugs at opposite sides; and a sealing fin extending over the top end wall and the triangular lugs, said sealing fin being formed by joining inside layers of the packing material in a sealing bond, said sealing fin being folded down along a portion of its length against the top end wall and being retained in its folded down position, a region in said sealing bond being adapted to be torn open in order to unfold said sealing fin for forming a rhomboid opening in said package, the improvement comprising a first cut located in the layer of packing material of said sealing fin which is nearest to the top end wall of the package when said sealing fin is in the folded down position, said first cut being spaced from said triangular lug and a second cut in said sealing fin at an intersection of the top end wall and one of the side walls where the triangular lug joins the top end wall, whereby said first cut facilitates formation of said rhomboid opening.

2. The package in accordance with claim 1, wherein said cut is provided in the part of the sealing fin which is located on the top end wall and within the region of the sealing fin which is adapted to be torn open so that a channel into the interior of the package is established with the region of the sealing fin forming the opening of the emptying channel.

3. The package in accordance with claim 1, wherein said first cut is arranged in the sealing fin at an inner part of the region in said sealing fin which is adapted to be torn open, said inner part being defined by two crease-lines extending from a corner of the top end wall and diverging from a divergence point defined at the corner of the top end wall.

4. The package in accordance with claim 3, wherein the fin defines a base line extending longitudinally of the top wall, the two crease-lines being arranged in such a manner to define a first pair of crease-lines originating from a first corner of the top end wall, a second pair of crease-lines originating from a second corner of the top end wall, said first pair and said second pair of crease-lines extending divergently over the top end wall up to the base line of the fin and extending from opposite corners so as to encompass substantially the same part of the fin.

5. The package in accordance with claim 1, wherein the sealing fin is provided with a longitudinal axis and said cut is arranged at a right angle to the longitudinal axis of the sealing fin.

6. The package in accordance with claim 1, wherein said package is manufactured from a weblike packing material, said material including a base layer of paper and a plastic layer laminated to the base layer, said plastic layer being a liquid-tight, inside layer of the package, said plastic layer functioning as an adhesive during the sealing of the package, whereby plastic layers placed together in a sealing zone are fused together under heat and pressure.

* * * * *